US010731438B2

(12) United States Patent
Hazel et al.

(10) Patent No.: US 10,731,438 B2
(45) Date of Patent: Aug. 4, 2020

(54) DOWNHOLE WELL TUBULAR STRUCTURE WITH VALVE SLEEVE

(71) Applicant: Welltec Oilfield Solutions AG, Zug (CH)

(72) Inventors: Paul Hazel, Aberdeen (GB); Ricardo Reves Vasques, Allerød (DK); Satish Kumar, Allerød (DK)

(73) Assignee: Welltec Oilfield Solutions AG, Zug (CH)

( * ) Notice: Subject to any disclaimer, the term of this patent is extended or adjusted under 35 U.S.C. 154(b) by 141 days.

(21) Appl. No.: 15/561,608

(22) PCT Filed: Mar. 23, 2016

(86) PCT No.: PCT/EP2016/056411
§ 371 (c)(1),
(2) Date: Sep. 26, 2017

(87) PCT Pub. No.: WO2016/156154
PCT Pub. Date: Oct. 6, 2016

(65) Prior Publication Data

US 2018/0119519 A1 May 3, 2018

(30) Foreign Application Priority Data

Mar. 27, 2015 (EP) ..... 15161398

(51) Int. Cl.
*E21B 34/14* (2006.01)
*E21B 34/06* (2006.01)
*E21B 34/00* (2006.01)

(52) U.S. Cl.
CPC ..... *E21B 34/14* (2013.01); *E21B 34/066* (2013.01); *E21B 2034/007* (2013.01)

(58) Field of Classification Search
CPC ..... E21B 34/14; E21B 2034/007
See application file for complete search history.

(56) References Cited

U.S. PATENT DOCUMENTS 4,043,392 A * 8/1977 Gazda ..... E21B 23/02 166/154
5,305,833 A 4/1994 Collins
(Continued)

FOREIGN PATENT DOCUMENTS

CN 103975123 A 8/2014
CN 104100225 A 10/2014
(Continued)

OTHER PUBLICATIONS

"Adjacent" Merriam-Webster Definition (Year: 2019).*
(Continued)

*Primary Examiner* — Robert E Fuller
*Assistant Examiner* — Theodore N Yao
(74) *Attorney, Agent, or Firm* — Nixon & Vanderhye P.C.

(57) ABSTRACT

The present invention relates to a downhole well tubular structure configured to be arranged in a borehole in a formation, comprising a well tubular part having an opening and an inner face, the well tubular part having an axial extension, a first sleeve configured to slide within the well tubular part along at least part of the inner face, the first sleeve having a first end face and a second end face, the first sleeve having a first sleeve groove facing away from the well tubular part, the first sleeve groove of the first sleeve having a first groove face extending radially and facing away from the first end face, and the first sleeve groove of the first sleeve having a second groove face inclining away from the first groove face, wherein the well tubular part has a first inclined face facing the first end face of the first sleeve, the first inclined face inclining from the inner face away from the first sleeve, wherein the well tubular part comprises a second inclined face facing the first inclined face, the second inclined face inclining from the inner face away from the first sleeve, and the first sleeve is configured to slide towards
(Continued)

the first inclined face while uncovering or covering the opening. The present invention also relates to a downhole system comprising a downhole well tubular structure according to the present invention and to a sleeve operating method for uncovering or covering an opening in the downhole well tubular structure according to the present invention.

16 Claims, 15 Drawing Sheets

(56) References Cited

U.S. PATENT DOCUMENTS

| | | | | |
|---|---|---|---|---|
| 5,711,372 | A | 1/1998 | Stokley | |
| 8,291,982 | B2 | 10/2012 | Murray et al. | |
| 8,297,367 | B2 | 10/2012 | Chen et al. | |
| 9,080,415 | B2 | 7/2015 | Hallundbæk et al. | |
| 9,366,109 | B2 * | 6/2016 | Themig | E21B 34/14 |
| 9,382,790 | B2 | 7/2016 | Bertoja et al. | |
| 9,518,439 | B2 | 12/2016 | Hallundbæk et al. | |
| 2009/0044944 | A1 * | 2/2009 | Murray | E21B 43/02 166/308.1 |
| 2015/0053408 | A1 * | 2/2015 | Purkis | E21B 34/14 166/308.1 |

FOREIGN PATENT DOCUMENTS

| | | | |
|---|---|---|---|
| RU | 2 475 626 | C2 | 2/2013 |
| RU | 2 524 219 | C1 | 7/2014 |
| RU | 2 541 965 | C1 | 2/2015 |
| WO | WO 2013/150304 | | 10/2013 |

OTHER PUBLICATIONS

International Search Report and Written Opinion of the ISA for PCT/EP2016/056411 dated Jul. 5, 2016, 12 pages.

Extended European Search Report for EP 15161398, dated May 7, 2015, 7 pages.

Notification of the First Office Action dated Apr. 3, 2019 in Chinese Application No. 201680015224.7, with English translation, 18 pages.

Decision on Patent Grant for Invention dated Sep. 2, 2019 in Russian Application No. 2017136454/03(063565), with English translation, 13 pages.

* cited by examiner

DOWNHOLE WELL TUBULAR STRUCTURE WITH VALVE SLEEVE

This application is the U.S. national phase of International Application No. PCT/EP2016/056411 filed 23 Mar. 2016, which designated the U.S. and claims priority to EP Patent Application No. 15161398.1 filed 27 Mar. 2015, the entire contents of each of which are hereby incorporated by reference.

FIELD OF THE INVENTION

The present invention relates to a downhole well tubular structure configured to be arranged in a borehole in a formation. The present invention also relates to a downhole system comprising a downhole well tubular structure according to the present invention and to a sleeve operating method for uncovering or covering an opening in the downhole well tubular structure according to the present invention.

BACKGROUND ART

Opening or closing sliding sleeves in a well downhole is often performed by an operation tool having projectable keys, where each sleeve has a profile matching the profile of the key. When having sleeves with more positions than two, the operation of sliding sleeves has to be performed in several runs; one run for each position of the sleeve since the sleeves have different profiles in order to be able to be positioned in different positions, and thus the operation tool needs to change keys to match another profile of the sliding sleeve.

SUMMARY OF THE INVENTION

It is an object of the present invention to wholly or partly overcome the above disadvantages and drawbacks of the prior art. More specifically, it is an object to provide an improved well tubular structure and downhole system making the operation of sliding sleeves easier by making it possible to open and/or close several multi-position sliding sleeves in one run.

The above objects, together with numerous other objects, advantages and features, which will become evident from the below description, are accomplished by a solution in accordance with the present invention by a downhole well tubular structure configured to be arranged in a borehole in a formation, comprising:

- a well tubular part having an opening and an inner face, the well tubular part having an axial extension, and
- a first sleeve configured to slide within the well tubular part along at least part of the inner face, the first sleeve having a first end face and a second end face, the first sleeve having a first sleeve groove facing away from the well tubular part, the first sleeve groove of the first sleeve having a first groove face extending radially and facing away from the first end face, and the first sleeve groove of the first sleeve having a second groove face inclining away from the first groove face, wherein the well tubular part has a first inclined face facing the first end face of the first sleeve, the first inclined face inclining from the inner face away from the first sleeve, and wherein the well tubular part comprises a second inclined face facing the first inclined face, the second inclined face inclining from the inner face away from the first sleeve, and the first sleeve is configured to slide towards the first inclined face while uncovering or covering the opening.

By having the first inclined face and a second inclined face, a projecting part of a downhole tool engaging the sleeve groove automatically slides off and disengages from the groove as the projecting part of the downhole tool slides along the first inclined face or the second inclined face and the projecting part is forced radially inwards out of engagement with the sleeve groove.

The first end face and/or a second end face of the first sleeve may incline.

By having inclined end faces, the projecting part of the tool engaging the groove is able to slide off and disengage from the groove.

Moreover, the well tubular part may comprise a tubular part groove in which the first sleeve slides and the first inclined face forms part of the tubular part groove.

Also, the well tubular part may comprise a projecting member, the projecting member having the first inclined face.

Furthermore, the first sleeve may comprise a second sleeve groove having a first groove face extending radially and a second groove face inclining towards the first inclined face.

By having a first and a second sleeve groove each having a second groove face inclining away from and towards the first inclined face, respectively, a downhole tool is able to open the sleeve when moving in a first direction and close the sleeve when moving in the second direction opposite the first direction.

Moreover, the second groove faces of the first and the second sleeve groove may incline towards each other.

Further, the second groove face may incline away from the inner face of the well tubular part and towards the first inclined face.

Also, the first end face and/or a second end face of the first sleeve may incline.

Further, the well tubular part may comprise a second opening displaced in the axial extension in relation to the first opening.

Moreover, the downhole well tubular structure according to the present invention may further comprise a second sleeve configured to slide within the well tubular part along at least part of the inner face, the second sleeve having a first end face and a second end face, and the second sleeve having an inclined sleeve face being the first end face or the second end face, the inclined sleeve face facing the first inclined face and inclining away from the first sleeve.

Also, the first and the second sleeves may slide within the same tubular part groove.

Furthermore, the second sleeve may in one position be arranged adjacent the second end face of the first sleeve. And the first sleeve may be arranged between the first inclined face and the second sleeve.

The second sleeve may comprise a first sleeve groove facing away from the well tubular part, the first sleeve groove of the second sleeve having a first groove face extending radially and facing away from the first end face.

In addition, the second sleeve groove may have a second groove face inclining towards the first inclined face.

Further, the second end face of the first sleeve may incline.

Also, the second end face of the second sleeve may incline.

Moreover, the well tubular part may comprise a third opening displaced in the axial extension in relation to the second opening.

The downhole well tubular structure as described above may further comprise a third sleeve configured to slide within the well tubular part along at least part of the inner face, the third sleeve having a first end face and a second end face, and the third sleeve having an inclined sleeve face being the first end face or the second end face, the inclined sleeve face facing the first inclined face and inclining away from the first sleeve.

In addition, the second sleeve may be arranged between the first sleeve and the second sleeve.

Additionally, the first inclined face and/or the second inclined face may incline with an angle of 20-70° from the axial extension.

The second opening may be larger than the first opening.

Furthermore, a screen may be arranged on an outer face of the well tubular part opposite the opening.

Also, a screen may be arranged in the sleeve.

Further, a valve, such as a constant flow valve or an inflow control valve, may be arranged in the opening.

Moreover, an identification tag may be arranged in the sleeve and/or in the well tubular part.

A self-closing mechanism may be configured to move the sleeve away from the first inclined face.

In addition, the sleeve may have a circumferential recess and a sealing element arranged in the recess.

The one or more sleeve(s) may comprise a locking mechanism locking into a recess in the well tubular part in order to lock the sleeve in the axial extension.

Furthermore the downhole well tubular structure may be made of metal and thus be a downhole well tubular metal structure.

Moreover, the well tubular part may be made of metal and thus be a well tubular metal part.

Also, the sleeve may be made of metal and thus be a metal sleeve.

The present invention also relates to a downhole system comprising a downhole well tubular structure according to any one of the preceding claims, and a downhole tool submersible into the well tubular structure, the downhole tool having a tool body and a first projecting part projectable from the tool body, the projecting part having a profile, the profile comprising an indentation between a first engagement member and a second engagement member, each engagement member having an inclined face facing away from the indentation, the indentation having two indentation faces extending radially to the axial extension, wherein one of the engagement members is configured to engage the groove of the sleeve, while the other engagement member is arranged without engaging the sleeve.

The sleeve may have a first sleeve end part extending between the first end face and the first groove face, the indentation of the profile of the projecting part having an axial extension which is greater than the first sleeve end part along the axial extension, so that the indentation face of the projecting part is allowed to slide along the first inclined face.

Also, the projecting part may be springily suspended in the tool body by means of a spring, so that the projecting part is configured to slide along and within the well tubular structure in and out of engagement with the sleeve grooves.

Moreover, the spring may be a coil spring configured to provide the springy suspension of the projecting part.

Further, projecting part(s) of the tool may be projected by hydraulics.

Said projecting part(s) of the tool may be retracted by the spring.

Furthermore, the downhole tool may comprise a second projecting part arranged circumferentially opposite the first projecting part.

The present invention furthermore relates to a sleeve operating method for uncovering or covering an opening in the downhole well tubular structure as described above in the system as described above, the method comprising the steps of:

- inserting the downhole tool in the well tubular structure,
- moving the downhole tool forward in the well tubular structure in a first direction,
- projecting the projecting part from the tool body,
- moving the downhole tool further along the first direction, so that the projecting part slides along an inner face of the well tubular structure,
- letting the first engagement member of the projecting part slide past the first sleeve groove and the second engagement member of the projecting part project further to engage the first sleeve groove,
- moving the downhole tool further along the first direction, thereby displacing the sleeve from a first position to a second position to cover or uncover the opening, and
- sliding the projecting part along the inclined end face of the well tubular structure, thereby forcing the projecting part to retract and disengage the first sleeve groove.

Said sleeve operating method may further comprise the steps of:

- moving the downhole tool in a second direction opposite the first direction,
- sliding the projecting part past the first sleeve groove without engaging the first sleeve groove,
- moving the downhole tool further in the second direction,
- letting the second engagement member of the projecting part slide past the second groove and the first engagement member of the projecting part project further to engage the second sleeve groove,
- moving the downhole tool further in the second direction, thereby displacing the sleeve from the second position to the first position, and
- sliding the projecting part along the second inclined end face of the well tubular structure, thereby forcing the projecting part to retract and disengage the first sleeve groove.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
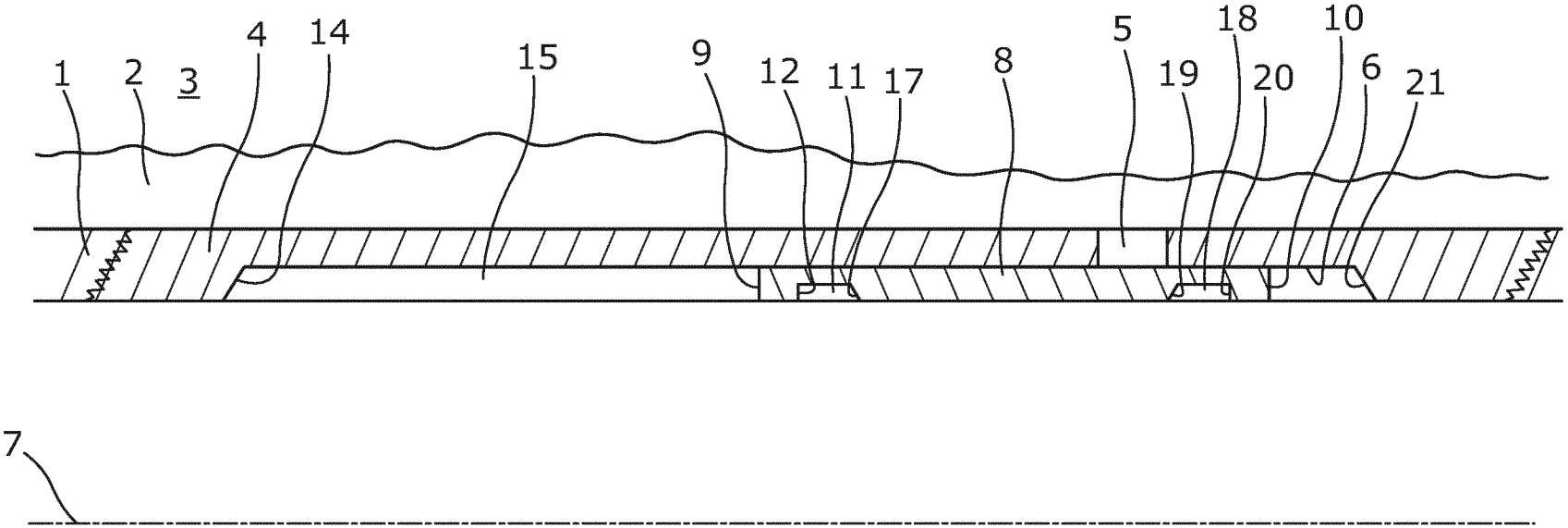
FIG. 1 shows a cross-sectional view of a downhole well tubular structure having a sleeve covering an opening.
Figure 2:
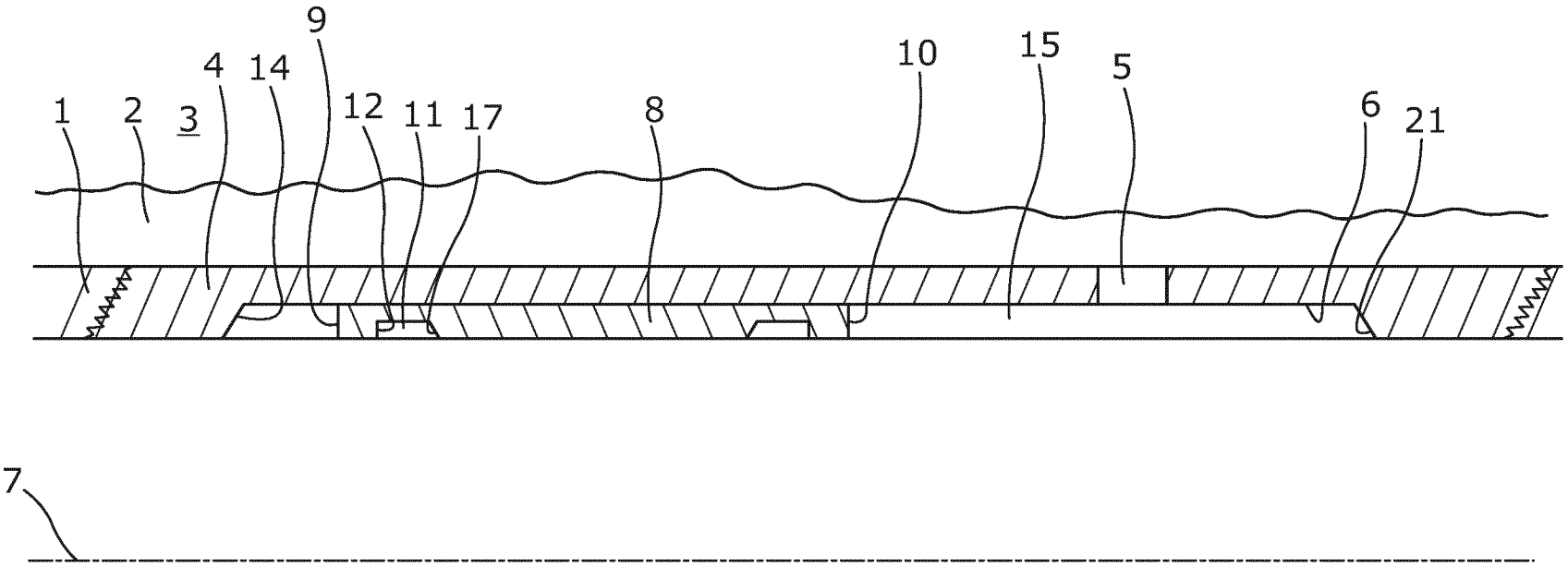
FIG. 2 shows a cross-sectional view of the downhole well tubular structure of FIG. 1, in which the sleeve is in a position uncovering the opening.

FIG. 1 shows a downhole well tubular structure 1 arranged in a borehole 2 in a formation 3. The well tubular structure comprises a well tubular part 4, also called a base pipe, having an opening 5 for allowing fluid from the formation to flow into the well tubular structure or from inside the well tubular structure into the formation, e.g. when the formation is fractured or an acid job is run. The well tubular structure 1 has an inner face 6 and an axial extension coincident with an axial extension 7 of the well tubular part. The well tubular structure 1 comprises a first sleeve 8 configured to slide within the well tubular part 4 along at least part of the inner face 6. The first sleeve 8 has a first end face 9 and a second end face 10, and the first sleeve 8 has a first sleeve groove 11 facing away from the well tubular part 4. The first sleeve groove 11 of the first sleeve comprises a first groove face 12 extending radially, substantially perpendicular to the axial extension 7 and facing away from the first end face 9. The first sleeve groove 11 further has a base face parallel with the axial extension and a second groove face 17 inclining from the base face away from the first groove face 12. The well tubular part 4 further comprises a first inclined face 14 facing the first end face 9 of the first sleeve 8, and the first inclined face 14 inclines from the inner face 6 of the well tubular part 4 away from the first sleeve 8. The first sleeve covers the opening 5 in FIG. 1 and is configured to slide along the inner face 6 to uncover the opening 5 and allow fluid to pass through the opening, as shown in FIG. 2.

By having the first inclined face 14, a projecting part 42 (shown in FIGS. 4B and 4C) of a downhole tool engaging the first sleeve groove 11 automatically slides off and disengages from the first sleeve groove as the projecting part of the downhole tool slides along the first inclined face 14 and the projecting part is forced radially inwards out of engagement with the first sleeve groove 11.

The well tubular part in FIG. 1 comprises a tubular part groove 15 in which the first sleeve 8 slides and the first inclined face 14 forms part of the tubular part groove 15. The well tubular part 4 comprises, at the opposite end of the first inclined face 14, a second inclined face 21 facing the first inclined face 14 and inclining from the inner face 6 away from the first sleeve. In FIG. 1, the first sleeve 8 comprises a second sleeve groove 18 having a first groove face 20 extending radially and substantially perpendicularly to the axial extension 7. The second sleeve groove 18 further comprises a base face parallel to the axial extension and a second groove face 19 inclining from the base face towards the first inclined face 14. By having a first sleeve groove 11 and a second sleeve groove 18, each groove having a second groove face 17, 19 inclining from the inner face 6 away from and towards the first inclined face 14, respectively, a downhole tool is able to open the sleeve when moving in a first direction and is able to close the sleeve when moving in a second direction opposite the first direction. Thus, the second groove faces of the first and the second sleeve groove incline towards each other.

Figure 3:
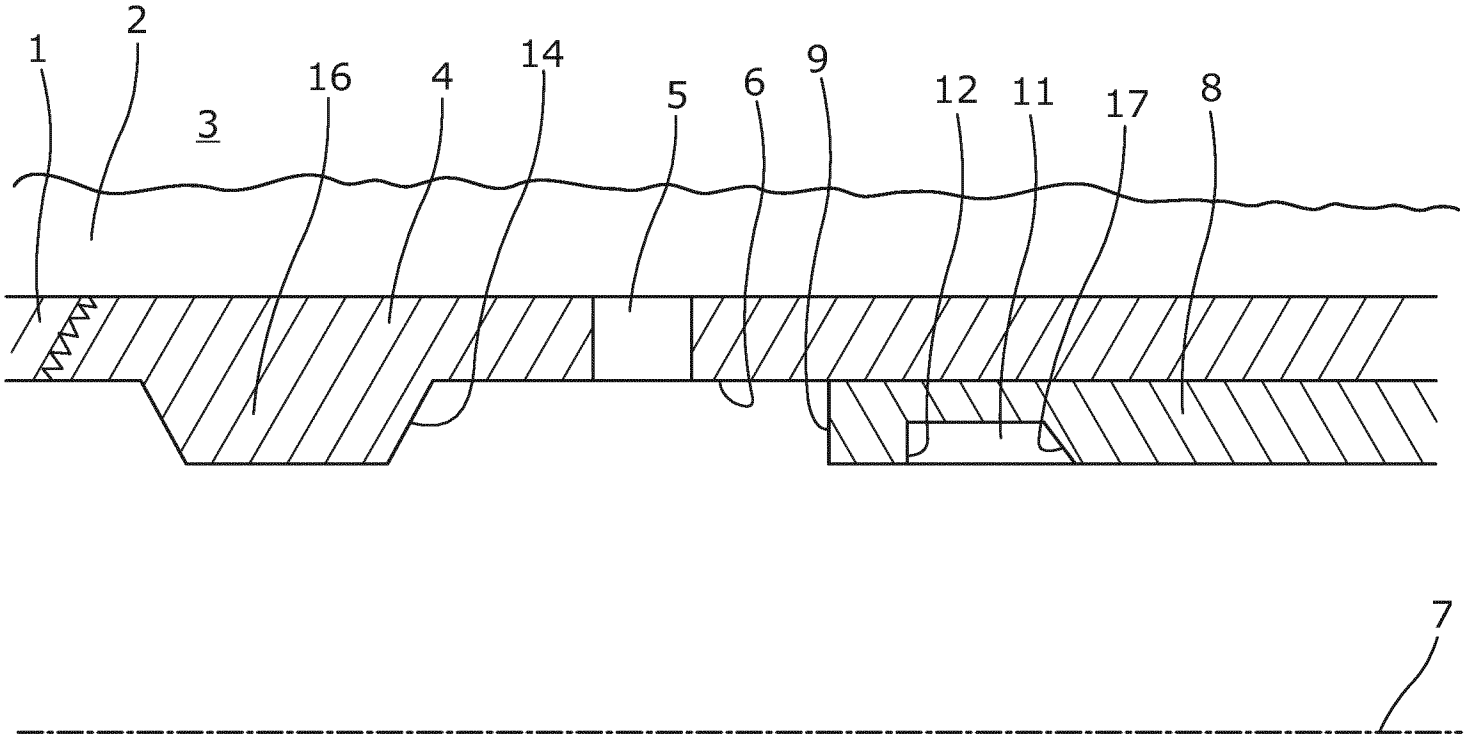
FIG. 3 shows a cross-sectional view of another downhole well tubular structure having a projection.

Instead of having a tubular part groove, the well tubular part may comprise a projecting member 16, so that the first inclined face 14 forms part of the projecting member, as shown in FIG. 3.

Figure 4A:
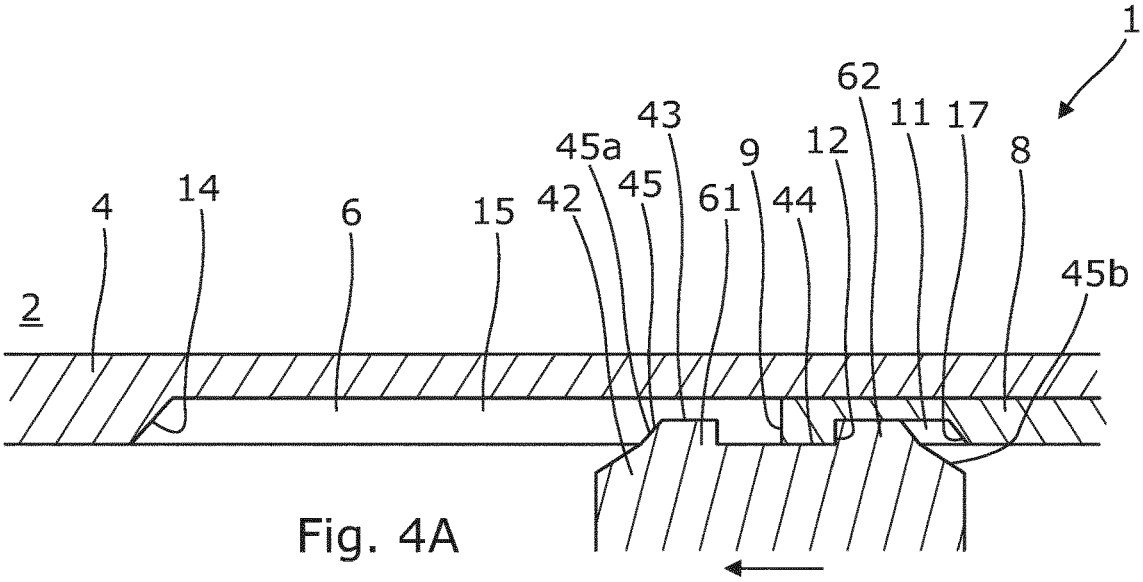
FIGS. 4*a-c* show a cross-sectional view of the downhole well tubular structure of FIG. 1 in which a projecting part engages the sleeve and moves the sleeve in a first direction from the position of FIG. 1 to the position of FIG. 2, FIGS. 4*d-g* show a cross-sectional view of the downhole well tubular structure of FIG. 1 in which a projecting part engages the sleeve and moves the sleeve in a second direction opposite the first direction from the position of FIG. 2 to the position of FIG. 1.
Figure 4B:
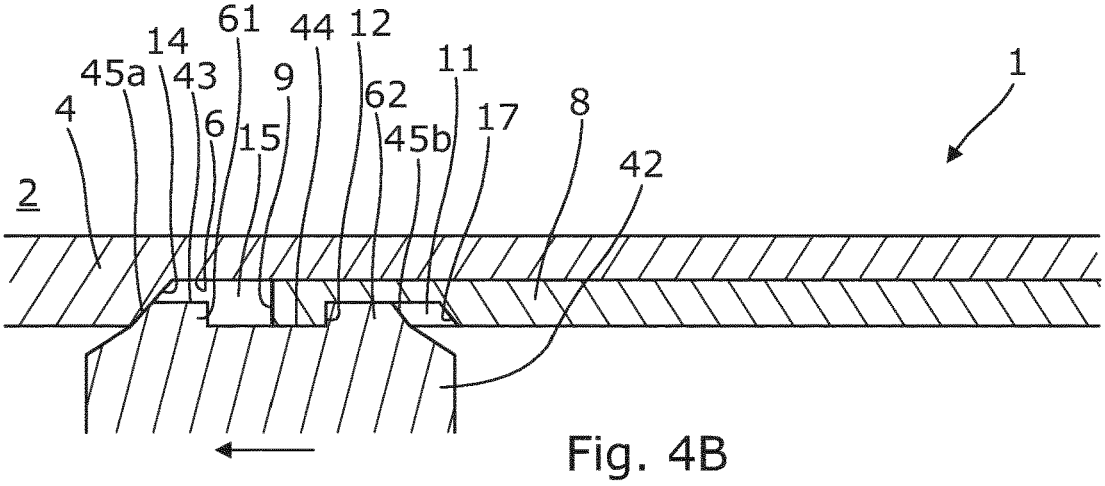
Figure 4C:
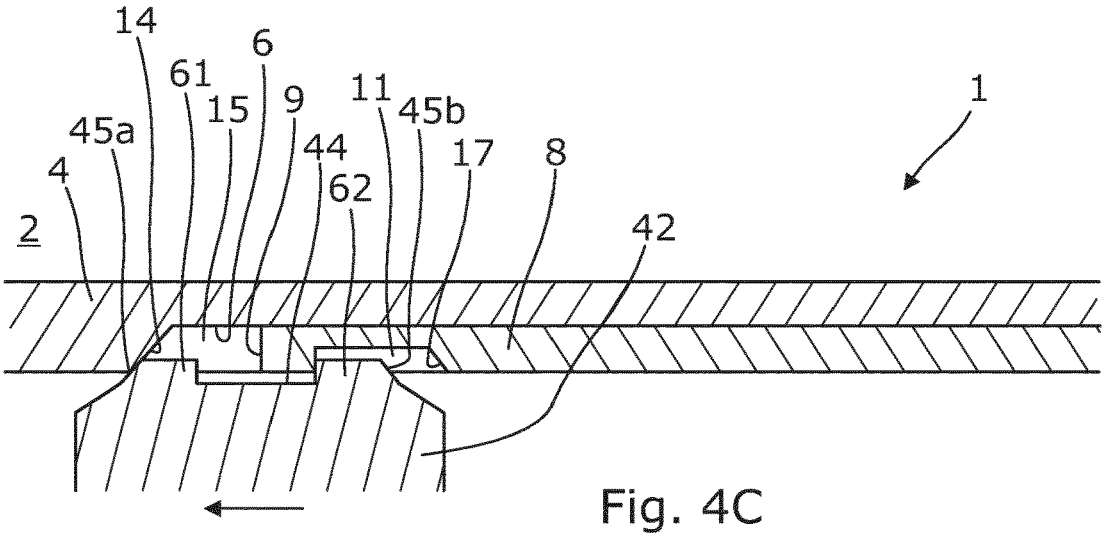

In order to slide the first sleeve from a first position as shown in FIG. 1 and partly in FIG. 4*a* to a second position as shown in FIG. 2, a downhole tool having a projecting part 42 is inserted into the well tubular structure. The projecting part 42 has a profile 43 which comprises an indentation 44 between a first engagement member 61 and a second engagement member 62. Each engagement member comprises an inclined face 45, 45*a*, 45*b* facing away from the indentation. While the downhole tool is moved upwards again, the projecting part 42 is projected to slide along the well tubular structure 1 and thus along the first sleeve 8. When reaching the first sleeve groove 11, the first engagement member 61 slides past the sleeve groove due to its inclined face 45*a* and the second engagement member 62 engages the sleeve groove, and the projecting part 42 projects radially simultaneously therewith. As the downhole tool moves further, as shown in FIG. 4*b*, the inclined face 45*a* of the first engagement member 61 hits against the inclined face 14 of the well tubular part 4 and the projecting part 42 is forced to retract, as shown in FIG. 4*c*, and the second engagement member 62 disengages the sleeve groove, leaving the sleeve in the position shown in FIG. 4*c*.

Figure 4D:
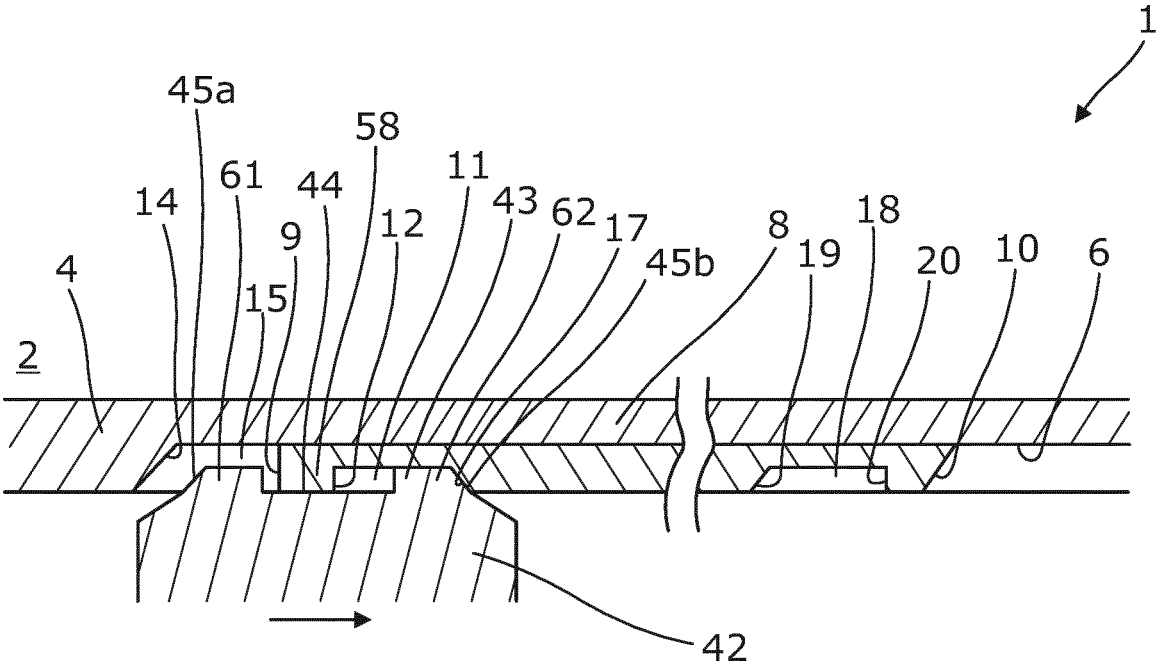
Figure 4E:
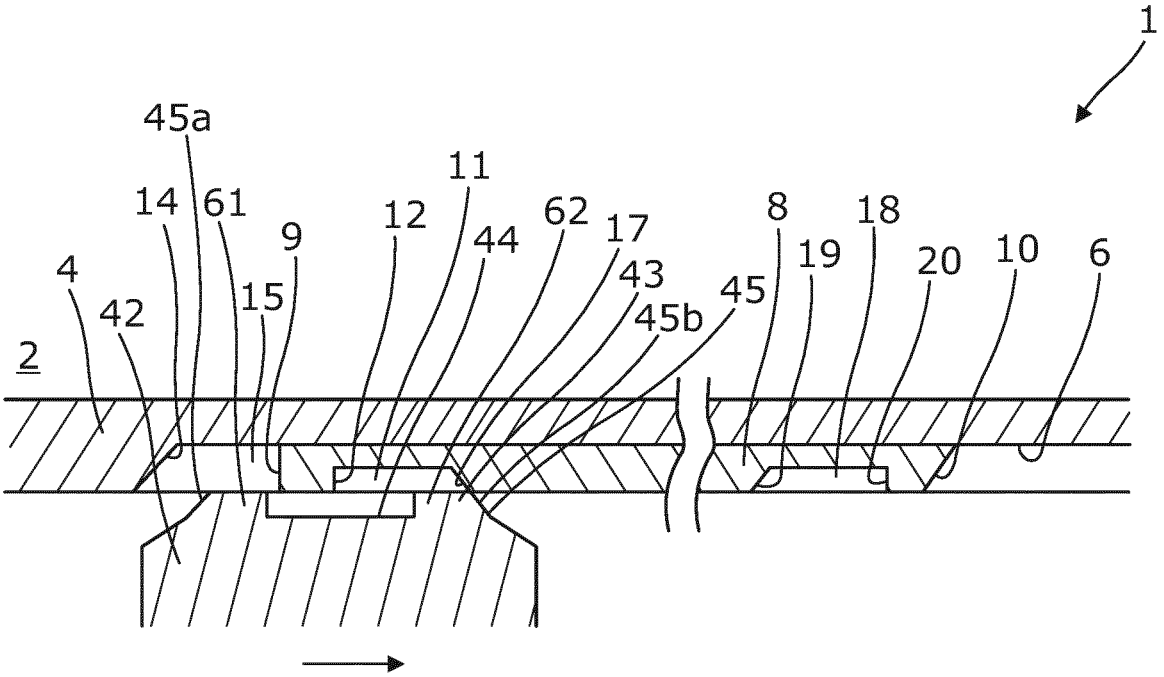
Figure 4F:
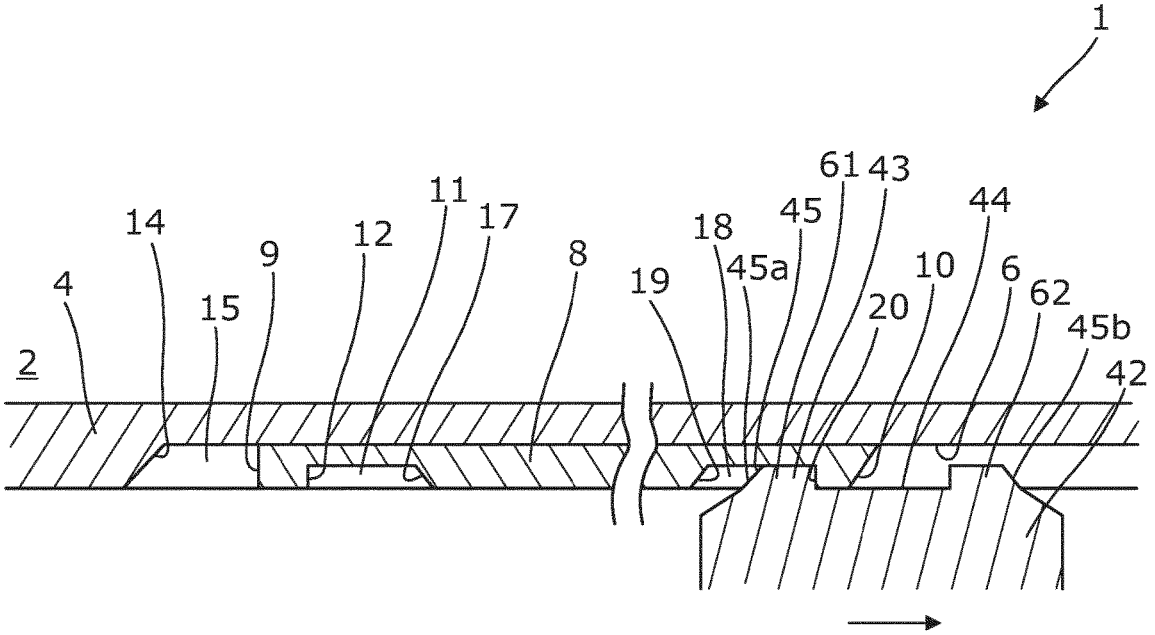
Figure 4G:
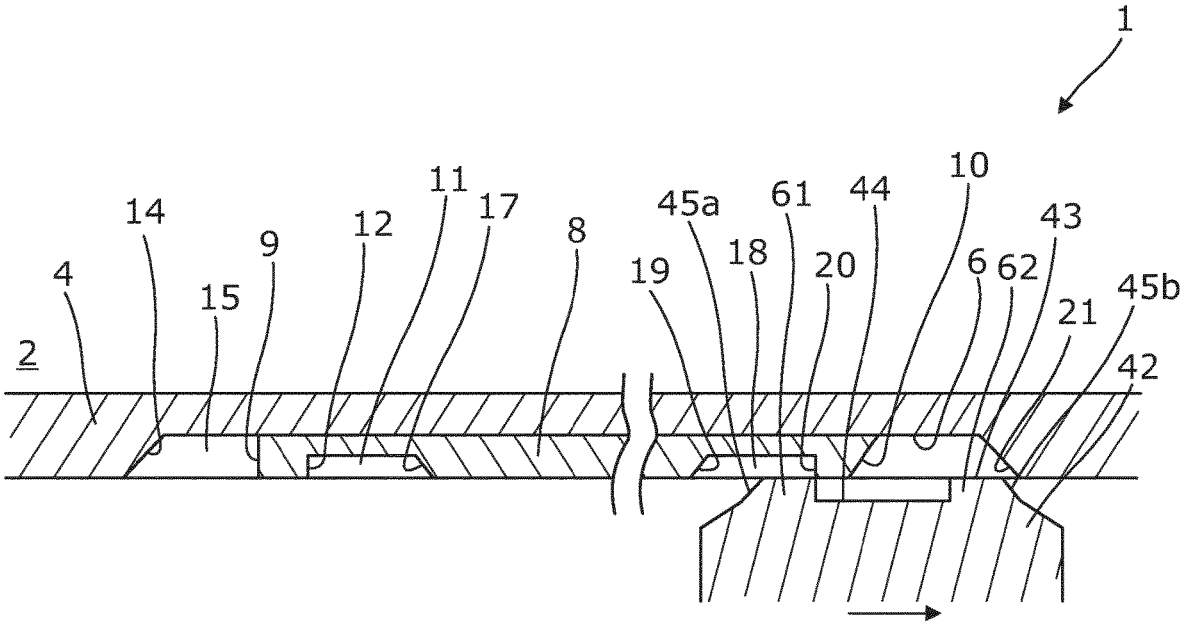

In FIG. 4*d*, the downhole tool moves further into the well while the projecting part 42 is projected and as the projecting part 42 slides along the well tubular part 4, the projecting part projects even further into the gap between the first inclined face 14 and the first end face 9 and into the first sleeve groove 11. As the downhole tool and the projecting part 42 move further down the well, the inclined face 45*b* of the second engagement member 62 abuts and slides along the inclined second groove face 17, forcing the projecting part 42 to slightly retract into the tool body and disengage the groove, as shown in FIG. 4*e*. While moving further down the well, the projecting part slides along the sleeve until the first engagement member 61 is opposite the second sleeve groove 18 and projects into the groove 18, as shown in FIG. 4*f*. While moving further in the same direction down the well, the first engagement member 61 of the projecting part 42 abuts the first groove face 20 and thus engages the second sleeve groove 18 and moves the first sleeve into the position shown in FIG. 1. As the projecting part 42 of the tool keeps moving further down the well, the inclined face 45*b* of the second engagement member 62 slides along a second inclined face 21 of the well tubular part, which forces the projecting part 42 to retract into the tool body, as shown in FIG. 4*g* where the profile of the projecting part 42 no longer engages the second sleeve groove 18.

Figure 5:
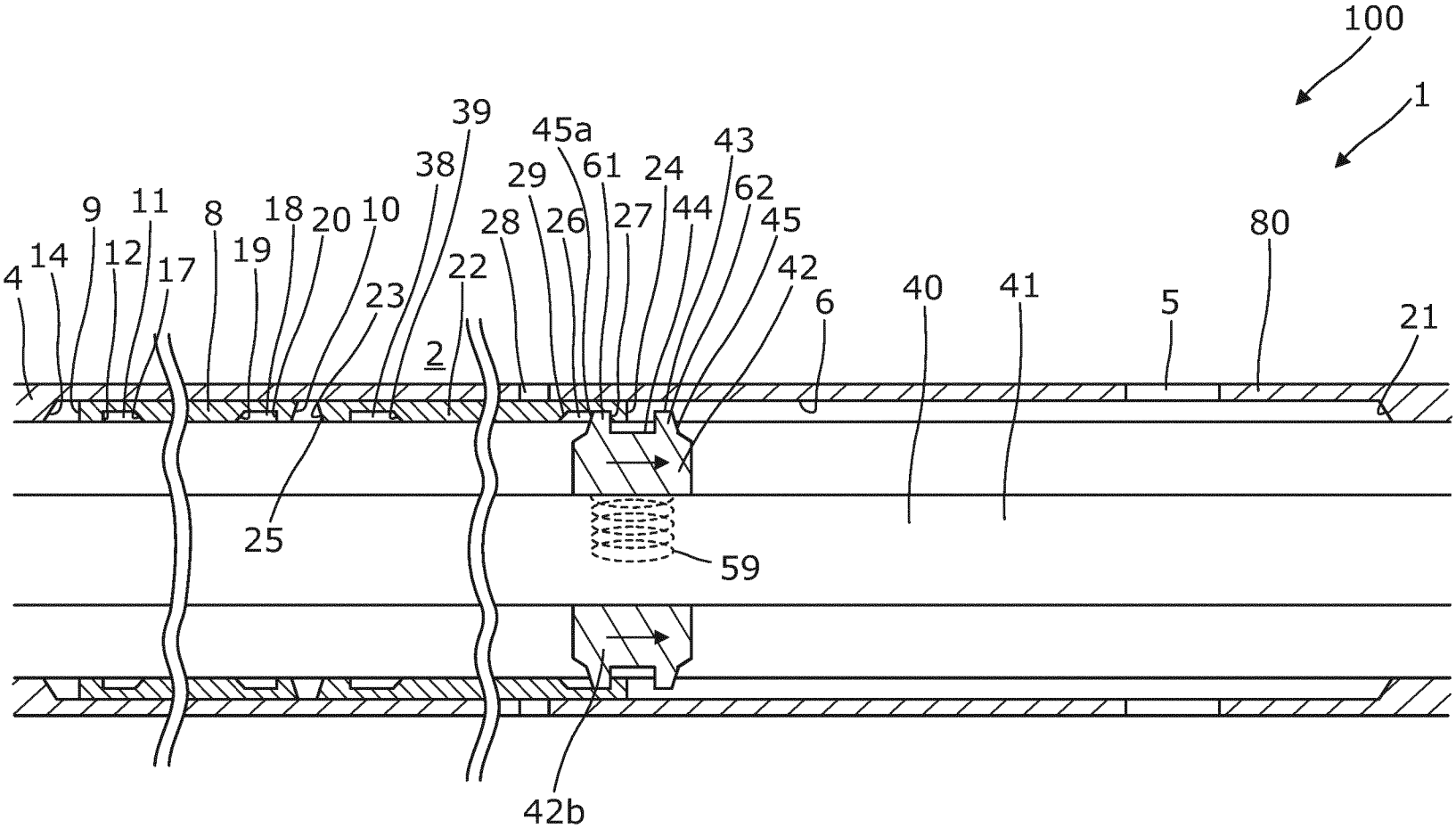
FIG. 5 shows a cross-sectional view of a downhole system having a downhole tool and another downhole well tubular structure having two sleeves.

In FIG. 5, the downhole well tubular structure further comprises a second sleeve 22 configured to slide within the same tubular part groove in the well tubular part along at least part of the inner face as the first sleeve 8. By having two sleeves within the same sliding sleeve assembly 80, each sleeve only has two positions and not the known multiple positions. Multiple position sleeves have shown to fail, and each multiple position sleeve needs different keys/profiles to change position, and thus the sleeve cannot be operated in all positions in one run. The reason for having multiple position sleeves is to open more than one opening in one sleeve assembly. By having two sleeves within the same sliding sleeve assembly 80, one tool having one profile on the projecting part 42 is needed, and thus the sleeves can be opened and/or closed for two openings using the same tool and in the same run due to the design of each sleeve.

As can be seen in FIG. 5, the second sleeve 22 has a first end face 23 and a second end face 24. The second sleeve has an inclined sleeve face 25 being the first end face 23. The inclined sleeve face inclines from the inner face 6 of the well tubular part 4 towards a first sleeve groove 26 of the second sleeve 22, and thus the inclined sleeve face 25 faces the first inclined face 14 and inclines away from the first sleeve 8. The first sleeve groove 26 of the second sleeve 22 has a first groove face 27 extending radially perpendicularly to the axial extension and facing away from the first end face. The second sleeve groove also comprises a base face substantially parallel to the axial extension and a second groove face 29 inclining from the base face towards the first inclined face 14.

In FIG. 5, the downhole tool 40 having a tool body 41 is arranged in the well tubular structure opposite the first sleeve groove 26 of the second sleeve 22. The first sleeve 8 and the second sleeve 22 are arranged so close that the projecting part 42 cannot engage the second groove 18 of the first sleeve 8 when the projecting part 42 moves in its projected position along the inner face of the sleeves 8, 22 and the well tubular part 4. One engagement member 61, 62 cannot engage the second groove of the first sleeve, since the other is at the same time arranged opposite a part of the sleeve having no groove.

Figure 6:
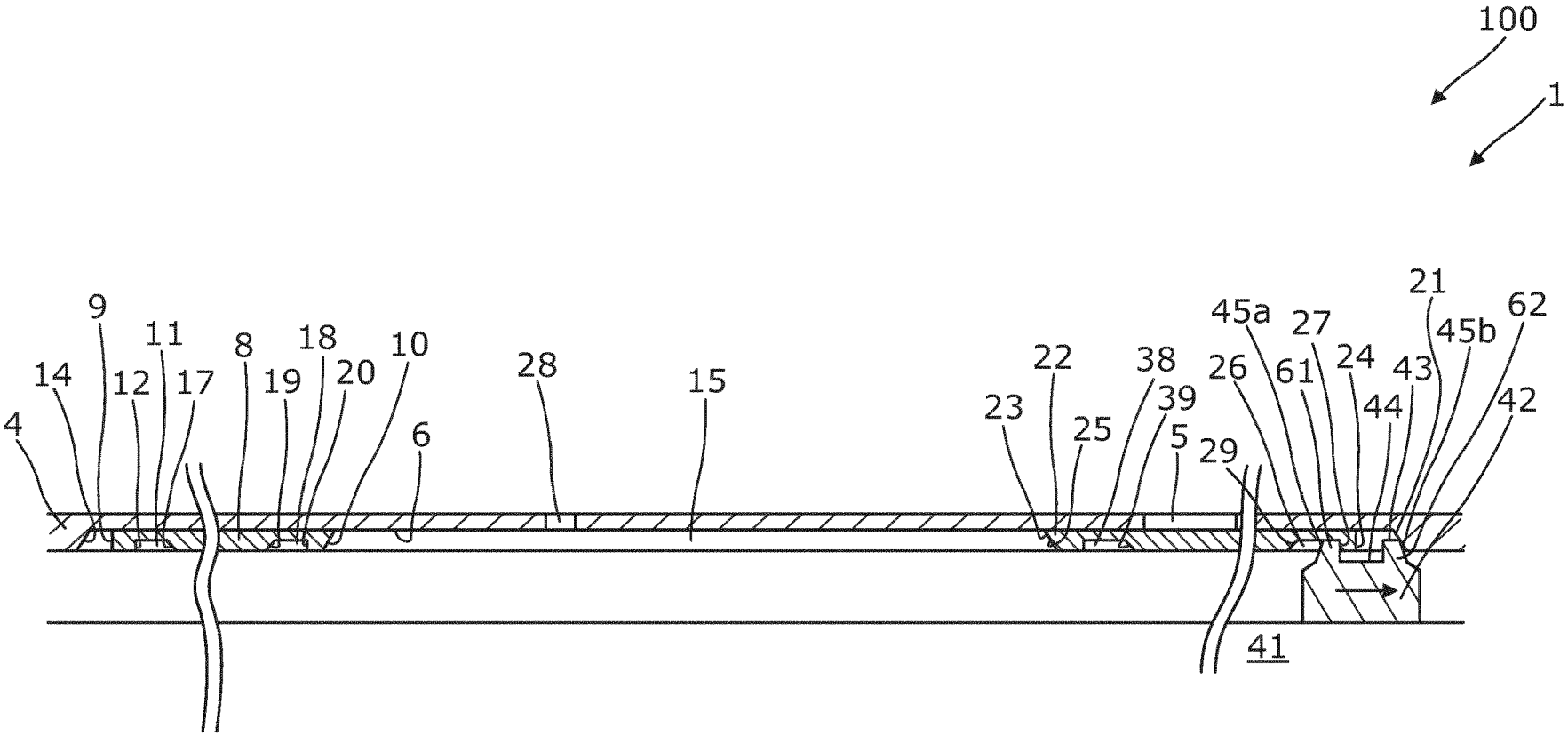
FIG. 6 shows a cross-sectional view of the downhole system of FIG. 5, in which the second sleeve has been moved.

Thus, the first sleeve groove 26 of the second sleeve 22 is the first groove in which the first engagement member 61 of projecting part 42 is able to engage when the tool moves from the first inclined face 14 towards the second inclined face 21. When engaging, the second engagement member 62 is arranged in front of the second sleeve outside the second sleeve in the gap between the second end face 24 of the second sleeve and the second inclined face 21 of the well tubular part 4. In FIG. 5, the second sleeve 22 covers a second opening 28 in the well tubular structure, and as the projecting part 42 moves towards the inclined face 21, the second sleeve moves to uncover the second opening 28, as shown in FIG. 6. By further movement of the tool down the well, the second inclined face 45*b*, shown in FIG. 6, of the second engagement member 62 slides along the inclined face 21, and the projecting part 42 is forced to somewhat retract, thereby forcing the first engagement member 61 to disengage the sleeve groove 26. Fluid is thus allowed to flow through the second opening 28, while the first opening 5 is covered and closed by the second sleeve 22. The first opening 5 is larger than the second opening 28 and the opening size can, in this way, be varied by displacing the second sleeve. In order to close the second opening 28 as well, the downhole tool is moved upwards and the projecting part 42 slides along the inner face of the sleeve until the second engagement member 62 is allowed to project into a second groove 38 of the second sleeve 22. As the projecting part 42 moves further towards the second opening, the first inclined face of the first engagement member 61 abuts the inclined second end face 10 of the first sleeve, and the first engagement member 61 slides along the inclined second end face 10 and the second engagement member 62 is forced to disengage the second sleeve groove 38, leaving the second sleeve in the position shown in FIG. 5, closing the second opening.

Figure 7:
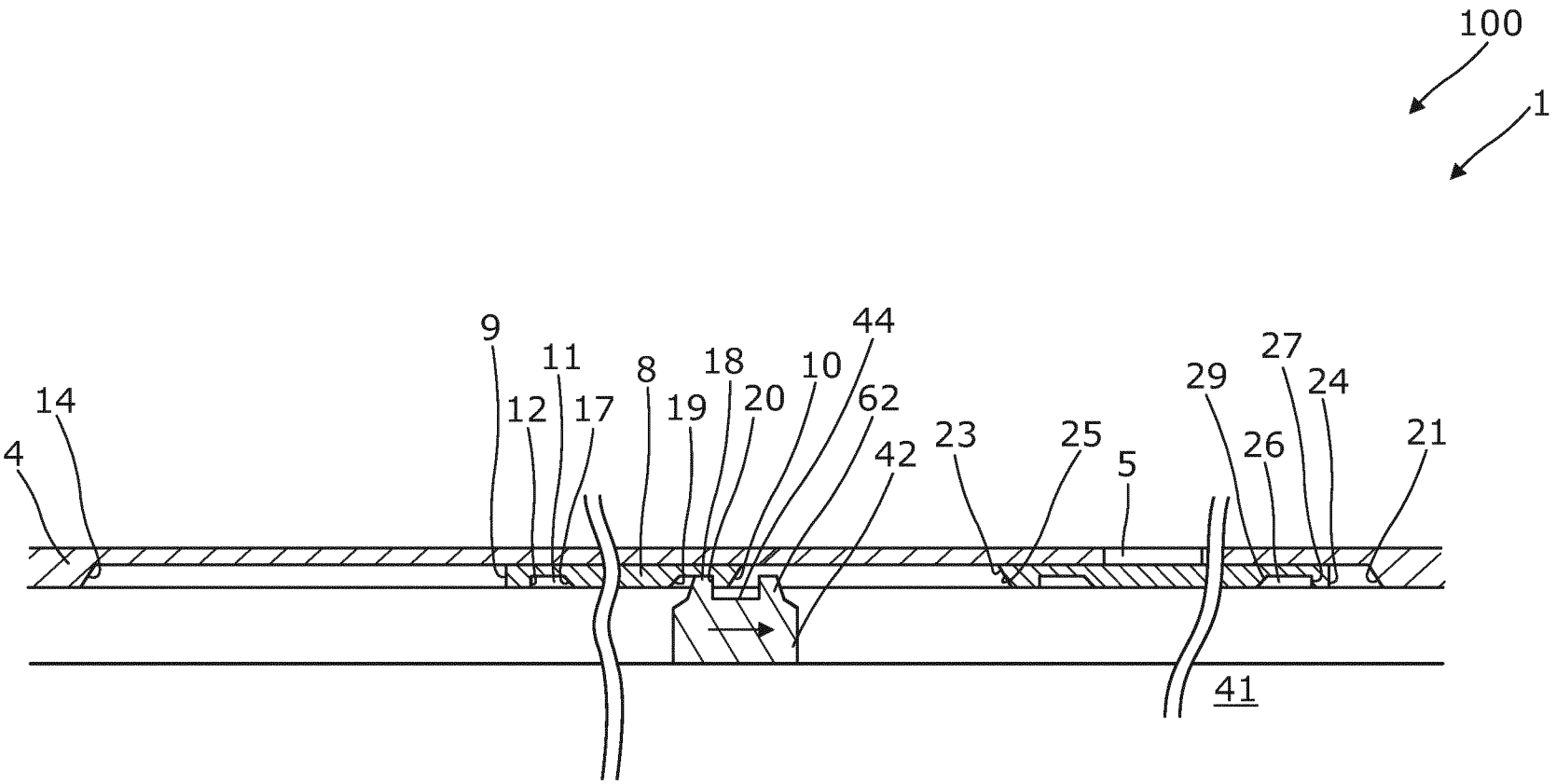
FIG. 7 shows a cross-sectional view of the downhole system of FIG. 5, in which the first sleeve is being moved.
Figure 8:
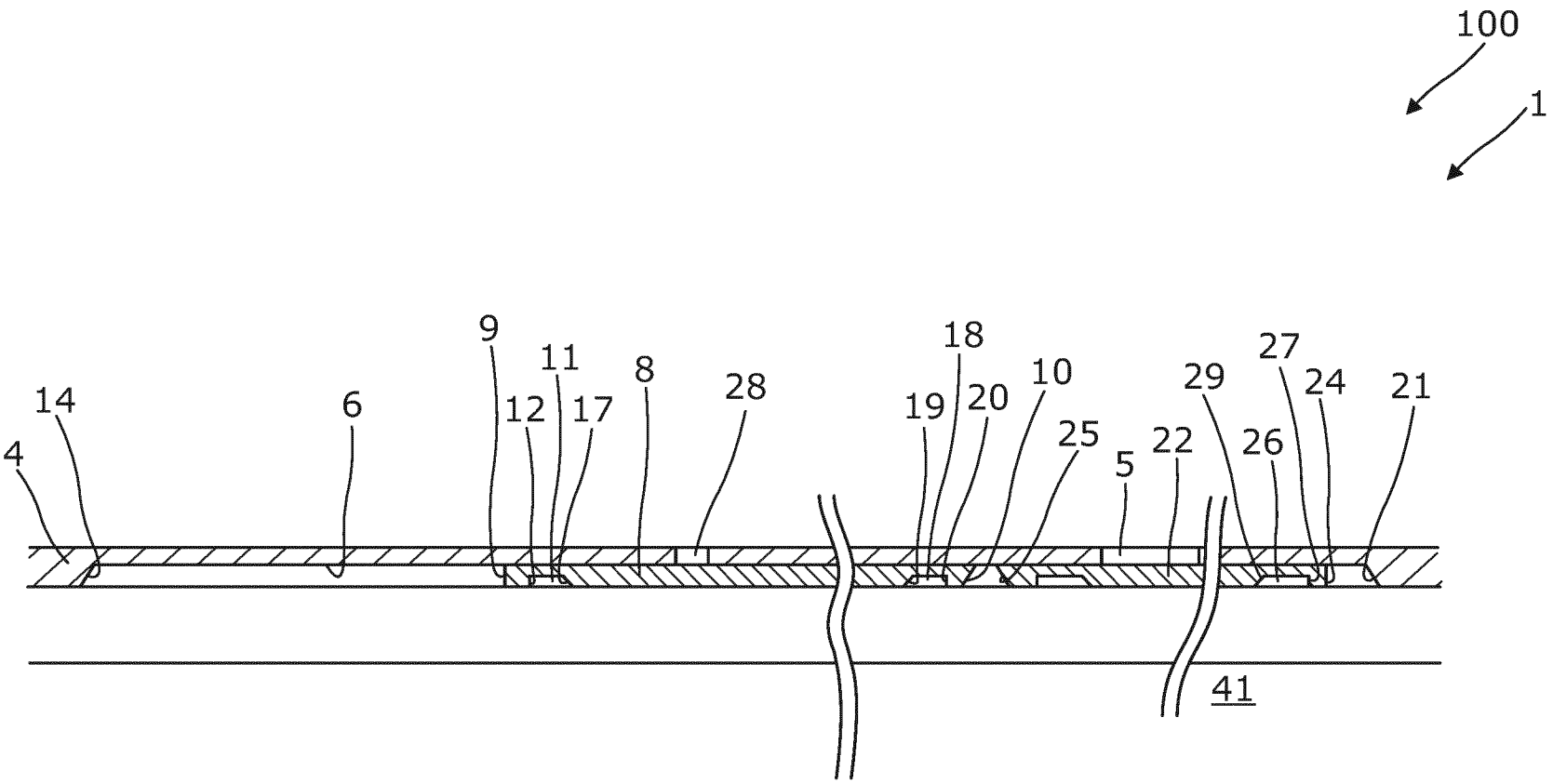
FIG. 8 shows a cross-sectional view of the downhole system of FIG. 5, in which both sleeves cover an opening.

The second end face 10 of the first sleeve 8 and the first end face 23 of the second sleeve 22 incline so that the projecting part 42 slides along the inclining end face and is forced to partly retract and disengage the wrong sleeve. By having two sleeves with opposing inclined end faces within the same groove 15, the projecting part 42 of the tool cannot engage the second sleeve groove 17 of the first sleeve 8 or the second sleeve groove 38 of the second sleeve 22 when the two sleeves 8, 22 are arranged close to each other in a first position as shown in FIG. 5, in which the first opening 5 is uncovered and thus open, or in a third position close to each other in which both openings are covered and thus closed. In a second position as shown in FIG. 6, the projecting part 42 of the tool can engage the second sleeve groove 18 of the first sleeve, as shown in FIG. 7, to move the first sleeve to the third position, shown in FIG. 8, or the projecting part 42 of the tool can engage the second sleeve groove 38 of the second sleeve 22 to move the second sleeve to the first position. Thus, the tool cannot engage the wrong sleeve but only the sleeve to be moved. When the tool moves in a first direction as shown in FIG. 5, the tool can only engage the first groove of the second sleeve and move the second sleeve to the second position shown in FIG. 6, due to the inclined face 45*b* and the inclined end faces 17, 25, 39. In the situation where the sleeves are positioned in the second position, the tool moving in the first direction can only engage the second sleeve groove 18 of the first sleeve 8, as shown in FIG. 7. In the situation where the sleeves are positioned in the second position, as shown in FIG. 6, the tool moving in a second direction opposite the first direction (thus in the opposite direction of the arrow shown in FIG. 6) can only engage the second groove 38 of the second sleeve 22 due to the inclined face 45*a* of the tool sliding along the inclined second groove face 29, and thus the tool is forced to disengage the first sleeve groove 26 before being able to move the sleeve 22. Therefore, the same tool having the same profile of the projecting part can open and close both the first opening and the second opening in one run without having to be withdrawn from the well to change profile.

The first inclined face and/or the second inclined face incline/inclines with an angle of 20-70° from the axial extension. In this way, the projecting part is able to slide towards the tool body and thus retract while the tool moves further in the well.

Even though it is not shown, a screen may be arranged on an outer face of the well tubular part opposite one of the openings.

Figure 10:
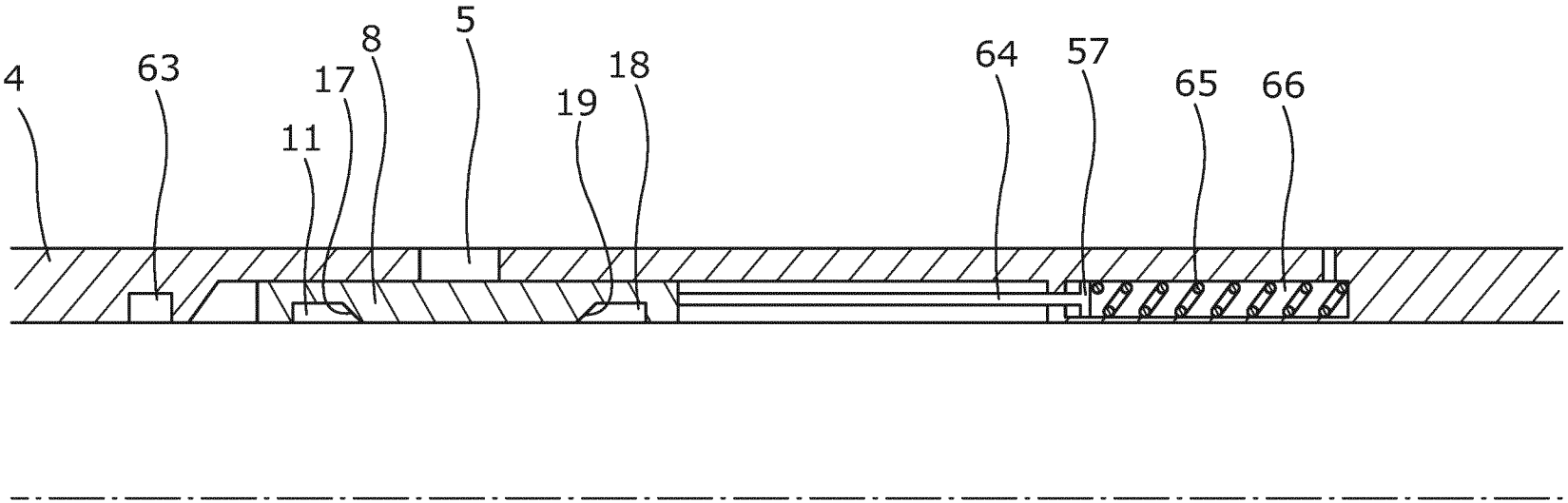
FIG. 10 shows a cross-sectional view of another downhole well tubular structure.

In order to properly identify which production zone is to be produced from and thus which sleeve is to open for flow through an opening, an identification tag 63 is arranged in the sleeve and/or the well tubular part, as shown in FIG. 10. The downhole well tubular structure comprises a detection unit for detection of the identification tag. As shown, the well tubular part sleeve comprises a self-closing mechanism 57 configured to move the sleeve towards from the first inclined face, so that when the sleeve is moved to open for flow through the opening 5, a spring 65 of the self-closing mechanism 57 is compressed by a piston 64 moving in a cavity 66. Thus, when the projecting part stops engaging the groove of the sleeve, the self-closing mechanism closes the opening by moving the sleeve to the initial position shown in FIG. 10.

Figure 9A:
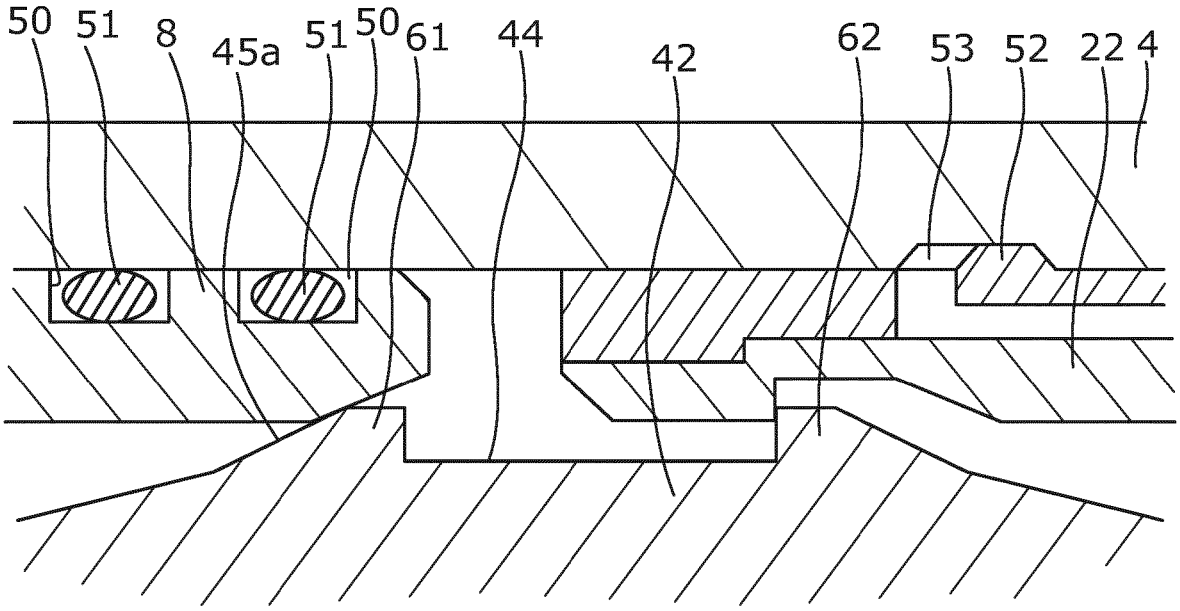
FIG. 9A shows a cross-sectional view of another downhole well tubular structure having a locking mechanism.

In FIG. 9A, the first sleeve has a circumferential recess 50 and a sealing element 51 arranged in the recess so as to provide a seal between the sleeve and the well tubular part 4. The second sleeve further comprises a locking mechanism 52 locking into a recess 53 in the well tubular part 4 for locking the sleeve in the axial extension. The locking mechanism is a spring pawl which projects radially outwards when possible, e.g. in the recess 53. By having a locking mechanism locking the sleeves, the sleeves are prevented from moving unintentionally when other tools pass the sleeves.

Figure 9B:
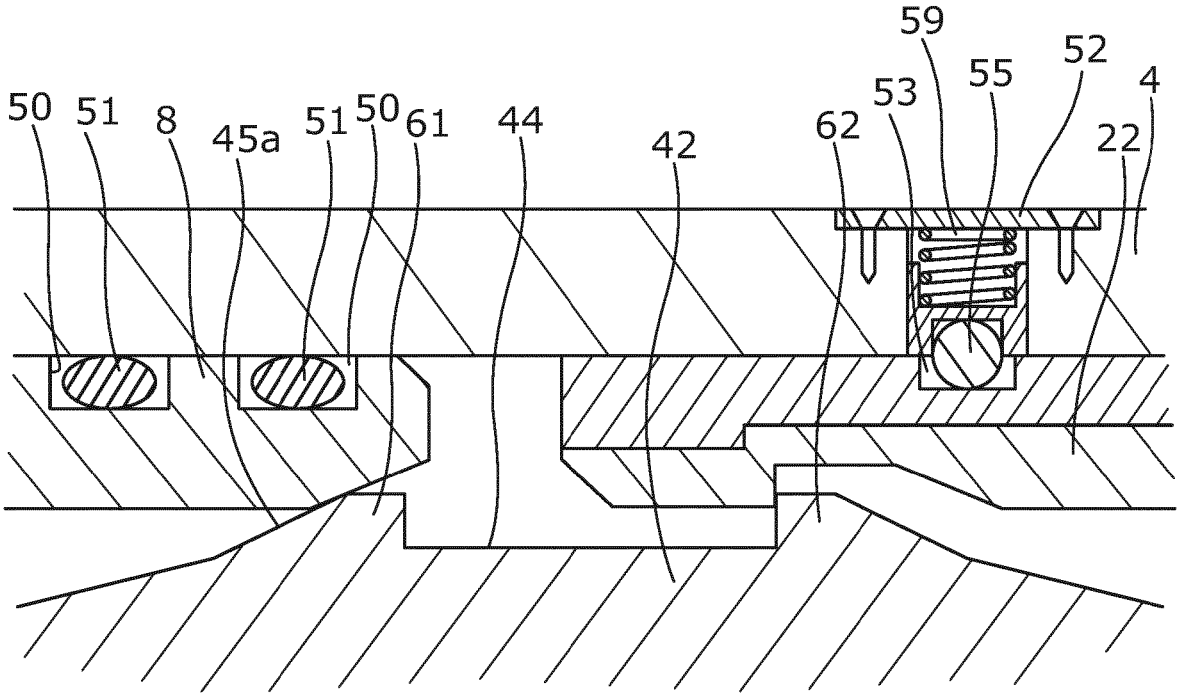
FIG. 9B shows a cross-sectional view of another downhole well tubular structure having another locking mechanism.

In FIG. 9B, the second sleeve comprises another locking mechanism 52 locking into a recess 53 in the well tubular part 4 in order to lock the sleeve in the axial extension. The locking mechanism 52 comprises a spring 59 forcing an element 55 radially inwards into a recess 53 when a recess of a sleeve is arranged opposite the locking mechanism 52. The element comprises a ceramic or metal ball engaging the recess.

In FIGS. 5 and 6, a downhole system 100 comprising a downhole well tubular structure 1 and a downhole tool 40 (shown in FIG. 11A) submersible into the well tubular structure is shown. The downhole tool has the tool body 41 and the first projecting part 42 is projectable from the tool body, and the projecting part has a profile 43, the profile comprising an indentation 44 between a first engagement member and a second engagement member, each engagement member having an inclined face 45, 45*a*, 45*b* facing away from the indentation, the indentation having the first and the second indentation faces extending radially to the axial extension, wherein one of the engagement members is configured to engage the groove of the sleeve, while the other engagement member is arranged without engaging the sleeve.

As shown in FIG. 4*d*, the sleeve has a first sleeve end part 58 extending between the first end face 9 and the first groove face 12, and the indentation 44 of the profile of the projecting part 42 has an axial extension greater than the first sleeve end part 58 along the axial extension, so that the inclined face 45 of the projecting part 42 is allowed to slide along the first inclined face or the second inclined face, as shown in FIG. 4*g*.

In order for the projecting part 42 to be able to slide along the sleeve and disengage or engage the groove of the sleeve, the projecting part is springily suspended in the tool body by means of a spring 59, such as a coil spring, as illustrated in FIG. 5.

As shown in FIG. 5, the downhole tool comprises a second projecting part 42*b* arranged circumferentially opposite the first projecting part.

When moving the projecting part 42, 42*b* to move a sleeve, it may only be part of the tool which is moving in relation to another fixed tool part. The fixed tool part may be fixed in the axial extension by means of an anchoring section, and the part moving may be moved by a stroking tool which is a tool providing an axial force along the axial extension. The stroking tool comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

Figure 11A:
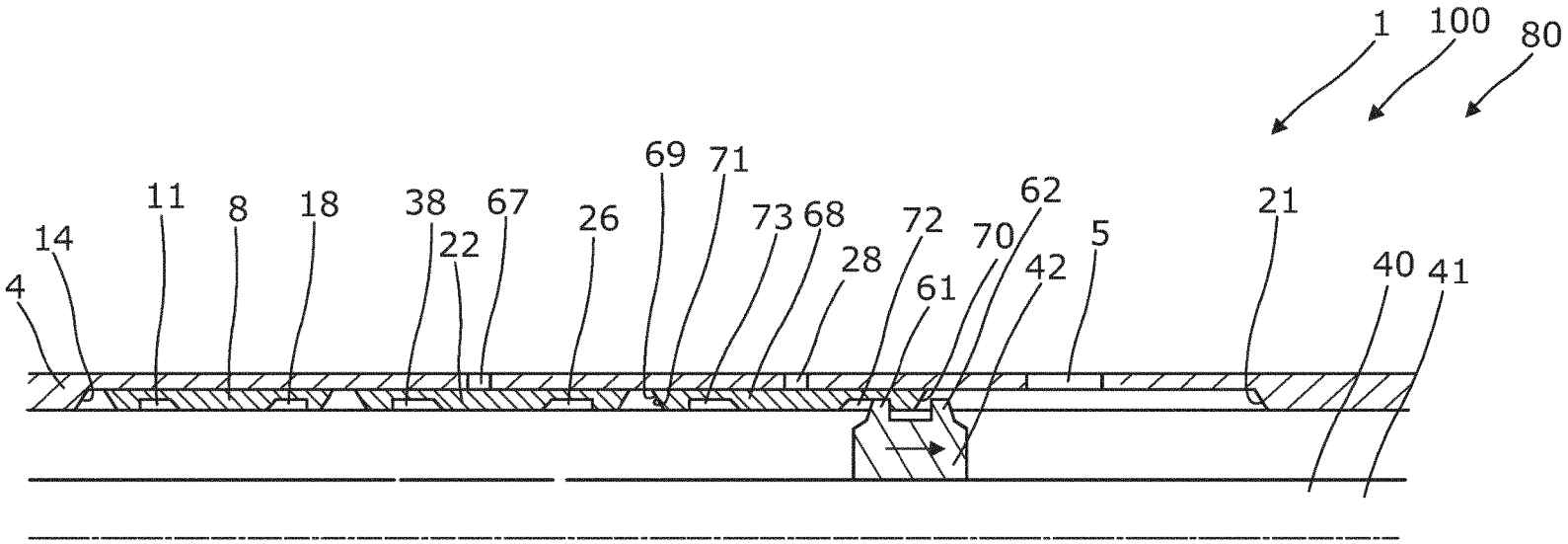
FIG. 11A shows a cross-sectional view of another downhole well tubular structure having three sleeves with the first opening being uncovered and the second and third openings being covered.

In FIG. 11A, the downhole well tubular structure 1 comprises three sleeves, the first sleeve 8, the second sleeve 22 and a third sleeve 68. The well tubular part 4 has three openings, the first opening 5, the second opening 28 and a third opening 67. In FIG. 11A, the three sleeves are arranged in a first position covering the second and third openings 28, 67, and the first opening 5 is open. The first opening 5 is larger than the second and third openings and is primarily used for fracturing the formation or providing acid into the fracture to increase formation contact. In FIG. 11A, the projecting part 42 of the tool 40 moving in the first direction towards the inclined face 21 is only able to engage the first sleeve groove 72 as inclined faces of the first and second sleeves force the projecting part to retract and disengage when sliding past the sleeves.

Figure 11B:
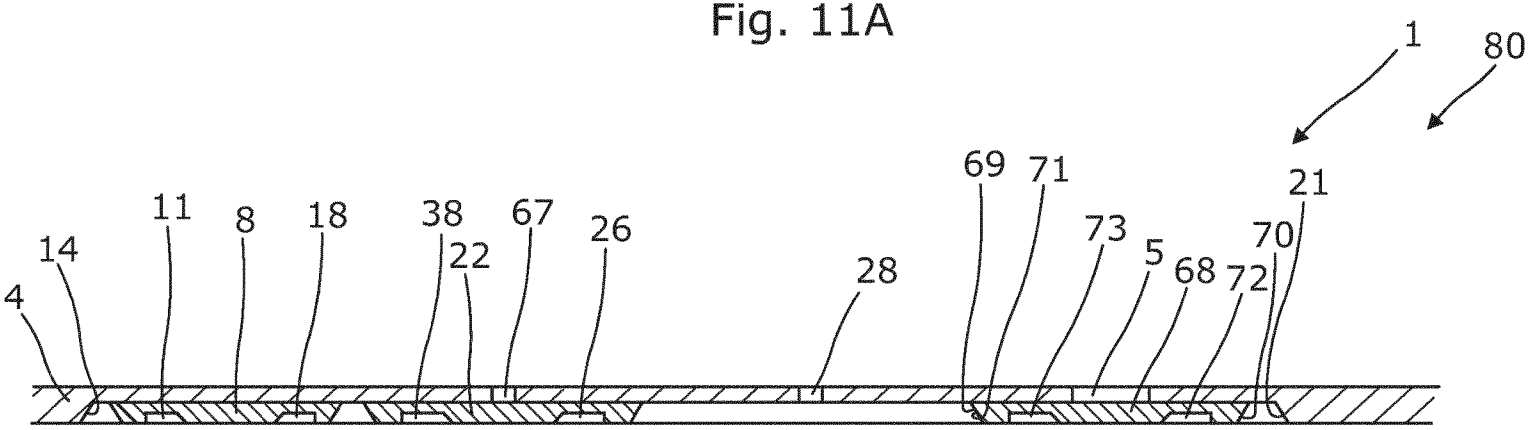
FIG. 11B shows the system of FIG. 11A with the second opening being uncovered and the first and third openings being covered.

In a second position as shown in FIG. 11B, the three sleeves are arranged in a second position covering the first and third openings 5, 67, and the second opening 28 is open. In this position, the projecting part 42 of the tool moving in the first direction can only engage the second sleeve groove 26 of the second sleeve to move the second sleeve to its second position being the third position, shown in FIG. 11C, or the projecting part of the tool can engage the second sleeve groove 73 of the third sleeve 68 to move the third sleeve to the first position. Thus, the tool cannot engage the wrong sleeve but only the sleeve to be moved, either the second sleeve when moving in the first direction or the third sleeve when moving in the second direction opposite the first direction.

Figure 11C:
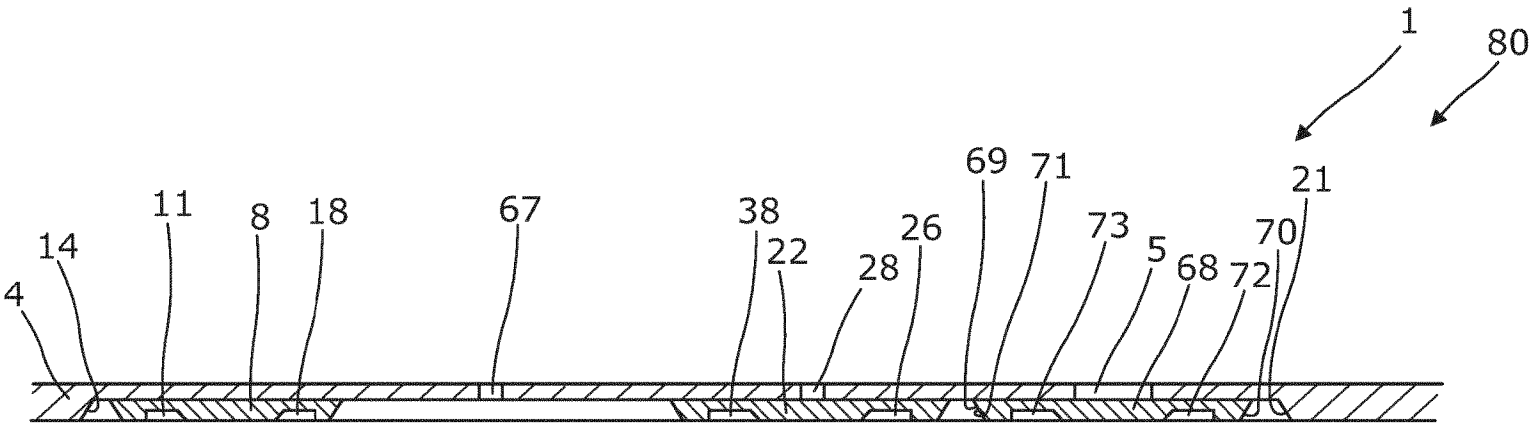
FIG. 11C shows the system of FIG. 11A with the third opening being uncovered and the first and second openings being covered.
Figure 11D:
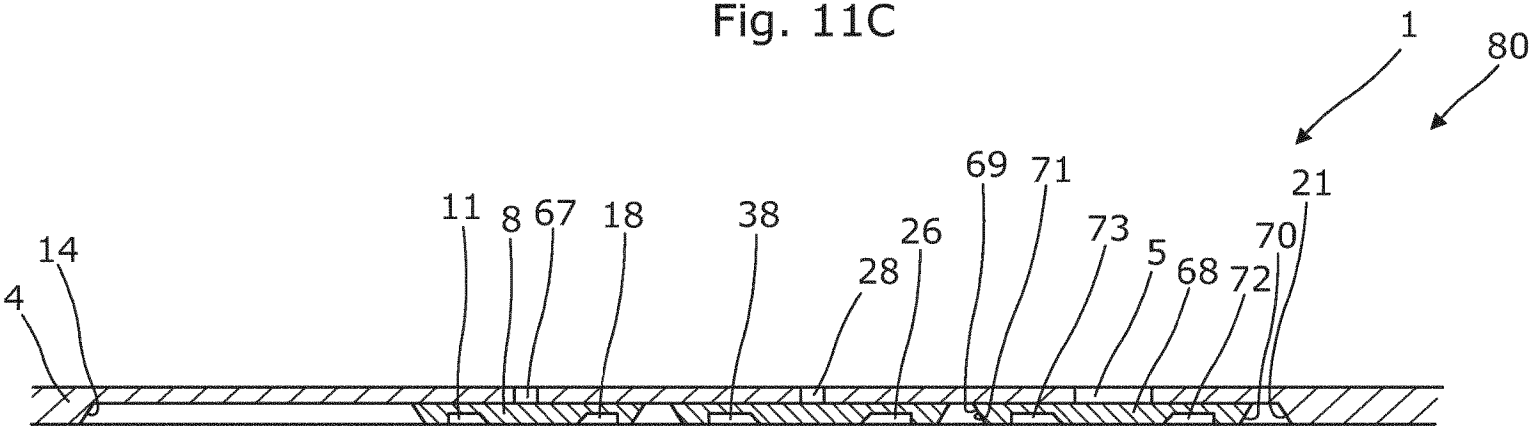
FIG. 11D shows the system of FIG. 11A with all openings being covered.

In a third position as shown in FIG. 11C, the three sleeves are arranged in a third position covering the first and second openings 5, 28, and the third opening 67 is open. In this position, the projecting part of the tool moving in the first direction can only engage the second sleeve groove 18 of the first sleeve 8 to move it to its second position being a fourth position as shown in FIG. 11D, closing the third opening 67 as well, or the projecting part of the tool moving in the second direction can engage the second sleeve groove 38 of the second sleeve 22 to move the second sleeve 22 to the second position, as shown in FIG. 11B. Thus, the tool cannot engage the wrong sleeve but only the sleeve to be moved, either the third sleeve when moving in the first direction, or the second sleeve when moving in the second direction opposite the first direction.

In the fourth position as shown in FIG. 11D, the three sleeves are arranged in a third position covering all openings. In this position, the projecting part of the tool moving in the first direction cannot engage any sleeves of this sleeve assembly 80 but moves past the sleeves to the next sleeve assembly. When the tool moves past this sleeve assembly in the second direction, the projecting part of the tool can only engage the first sleeve groove 11 of the first sleeve 8 for moving the first sleeve to its first position being the third position of the sleeve assembly 80, as shown in FIG. 11C. Thus, also in the fourth position, the tool cannot engage the wrong sleeve but only the sleeve to be moved, which is the first sleeve, when moving in the second direction opposite the first direction.

Figure 12:
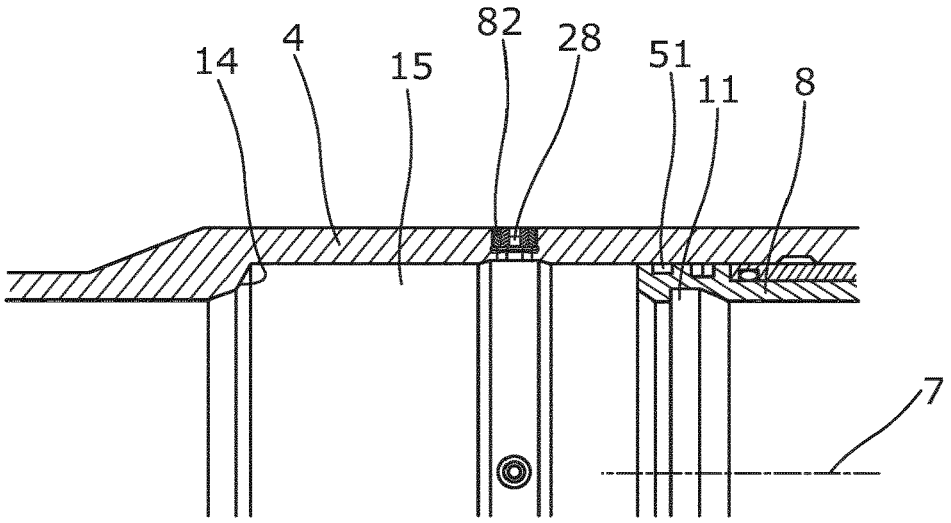
FIG. 12 shows a cross-sectional view of another downhole well tubular structure having a valve in the opening.
Figure 13:
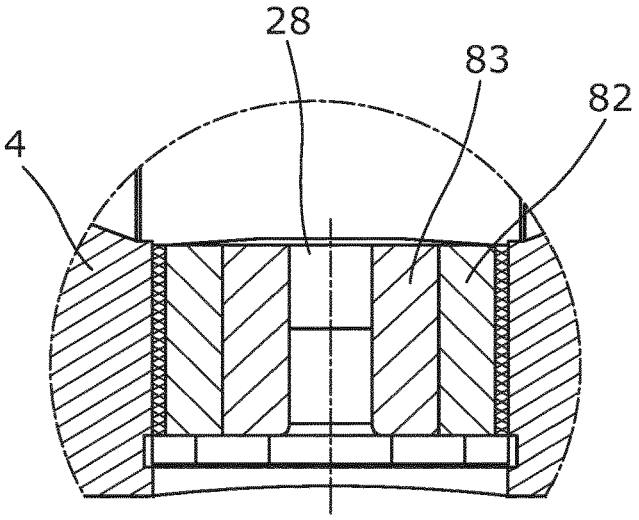
FIG. 13 shows an enlarged view of the valve of FIG. 12.
Figure 14:
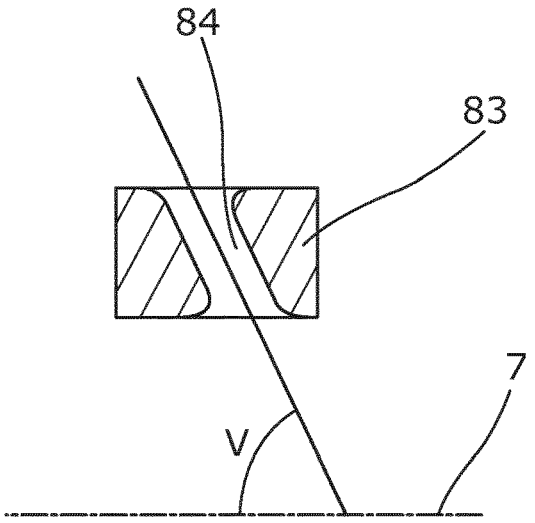
FIG. 14 shows a cross-sectional view of an insert in another embodiment of a valve.

In FIG. 12, a valve 82 is arranged in the opening 28. The valve 82 may be a constant flow valve or another kind of inflow control valve. The valve is shown in the second opening but may be arranged in any of the openings in the well tubular part 4. The valve 82 is shown in the enlarged view in FIG. 13, from which it appears that the valve has an insert 83 made of ceramics. The ceramic insert 83 has a through-bore extending radially, being perpendicular to the axial extension 7 (shown in FIG. 12). In FIG. 14, the insert 83 has an angled through-bore which has an angle v to the axial extension 7 to direct the flow of fluid into the well tubular structure.

By having the inclined faces and the sleeves almost abutting each other in a position, the sleeves prevent engagement of the projecting part into a wrong sleeve. Therefore, the same tool having the same profile of the projecting part or key can be used to move any sleeve from its first position to its second position to cover or uncover openings.

The sleeve assembly 80 may have more than three sleeves, and similarly the tubular part 4 may have a corresponding number of openings to be opened or closed.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By well tubular structure is meant a casing or any kind of pipe, tubing, tubular, liner, string etc. used downhole in relation to oil or natural gas production.

In the event that the tool is not submersible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole well tubular structure configured to be arranged in a borehole in a formation, comprising:

a well tubular part having an opening and an inner face, the well tubular part having an axial extension, and a first sleeve configured to slide within the well tubular part along at least part of the inner face, the first sleeve having a first end face and a second end face, the first sleeve including only first and second sleeve grooves facing away from the well tubular part, the first and second sleeve grooves being positioned adjacent the first and second end faces, respectively, each of the first and second sleeve grooves having a first groove face extending radially, and a second groove face angled relative to the first groove face, wherein the well tubular part has a first inclined face facing the first end face of the first sleeve, the first inclined face being angled relative to the inner face, and wherein the well tubular part comprises a second inclined face facing the first inclined face, the second inclined face being angled relative to the inner face, and the first sleeve is configured to slide towards the first inclined face while uncovering or covering the opening, wherein the first sleeve has a constant thickness as measured from the first end face to the first groove face of the first groove, and has a constant thickness as measured from the second end face to the first groove face of the second groove, and wherein the first sleeve includes an inner face where the only first and second grooves are located, the inner face being continuous and uninterrupted aside from the only first and second grooves.

2. A downhole well tubular structure according to claim 1, wherein the second groove faces of the first and the second sleeve grooves incline towards each other.

3. A downhole well tubular structure according to claim 1, wherein the first end face and/or the second end face of the first sleeve incline(s).

4. A downhole well tubular structure according to claim 1, wherein the well tubular part comprises a second opening displaced in the axial extension in relation to the first opening.

5. A downhole well tubular structure according to claim 1, further comprising a second sleeve configured to slide within the well tubular part along at least part of the inner face, the second sleeve having a first end face and a second end face, the second sleeve having an inclined sleeve face being the first end face or the second end face, the inclined sleeve face facing the first inclined face.

6. A downhole well tubular structure according to claim 5, wherein the second sleeve comprises a first sleeve groove facing away from the well tubular part, the first sleeve groove of the second sleeve having a first groove face extending radially and facing away from the first end face.

7. A downhole well tubular structure according to claim 1, wherein the well tubular part comprises a third opening displaced in the axial extension in relation to the second opening.

8. A downhole well tubular structure according to claim 1, further comprising a third sleeve configured to slide within the well tubular part along at least part of the inner face, the third sleeve having a first end face and a second end face, the third sleeve having an inclined sleeve face being the first end face or the second end face, the inclined sleeve face facing the first inclined face.

9. A downhole well tubular structure according to claim 1, wherein the first sleeve comprises a locking mechanism locking into a recess in the well tubular part in order to lock the first sleeve in the axial extension.

10. A downhole system including a downhole well tubular structure according to claim 1, wherein the first and second sleeve grooves are spaced apart from one another such that a projecting part of a downhole tool is only able to engage with either the first sleeve groove or the second sleeve grooves as the downhole tool is translated relative to the first sleeve, but the downhole tool is not able to engage with both the first and second sleeve grooves at the same time.

11. A downhole system comprising a downhole well tubular structure according to claim 1, and a downhole tool submersible into the well tubular structure, the downhole tool having a tool body and a first projecting part projectable from the tool body, the projecting part having a profile, the profile comprising an indentation between a first engagement member and a second engagement member, each engagement member having an inclined face facing away from the indentation, the indentation having two indentation faces extending radially to the axial extension, wherein one of the engagement members is configured to engage the first or second sleeve groove of the first sleeve, while the other engagement member is arranged without engaging the first sleeve.

12. A downhole system according to claim 11, wherein the sleeve has a first sleeve end part extending between the first end face and the first groove face, the indentation of the profile of the projecting part having an axial extension which is greater than the first sleeve end part along the axial extension, so that the indentation face of the projecting part is allowed to slide along the first inclined face.

13. A downhole system according to claim 11, wherein the projecting part is springily suspended in the tool body by means of a spring, so that the projecting part is configured to slide along and within the well tubular structure in and out of engagement with the sleeve grooves.

14. A downhole system according to claim 11, wherein the downhole tool comprises a second projecting part arranged circumferentially opposite the first projecting part.

15. A sleeve operating method for uncovering or covering an opening in the downhole well tubular structure according to claim 1, the method comprising:

inserting a downhole tool in the well tubular structure, moving the downhole tool forward in the well tubular structure in a first direction, projecting a projecting part from a tool body, moving the downhole tool further along the first direction, so that the projecting part slides along an inner face of the well tubular structure, letting a first engagement member of the projecting part slide past the first sleeve groove and a second engagement member of the projecting part project further to engage the first sleeve groove, moving the downhole tool further along the first direction, thereby displacing the first sleeve from a first position to a second position to cover or uncover the opening, and sliding the projecting part along the inclined end face of the well tubular structure, thereby forcing the projecting part to retract and disengage the first sleeve groove.

16. A sleeve operating method according to claim 15, further comprising:

moving the downhole tool in a second direction opposite the first direction, sliding the projecting part past the first sleeve groove without engaging the first sleeve groove, moving the downhole tool further in the second direction, letting the second engagement member of the projecting part slide past the second groove and the first engagement member of the projecting part project further to engage the second sleeve groove, moving the downhole tool further in the second direction, thereby displacing the sleeve from the second position to the first position, and sliding the projecting part along the second inclined end face of the well tubular structure, thereby forcing the projecting part to retract and disengage the first sleeve groove.

* * * * *